US010329503B2

(12) United States Patent
Factor et al.

(10) Patent No.: US 10,329,503 B2
(45) Date of Patent: Jun. 25, 2019

(54) FUEL BLEND WITH NANODIAMONDS

(71) Applicant: Nano MPI Holdings, Inc., Milford, MI (US)

(72) Inventors: Andrey Factor, Farmington Hills, MI (US); Marshall Weingarden, Milford, MI (US); Wladimir Borodin, Kharkov (UA); Volodymyr Ivashchenko, Kharkov (UA)

(73) Assignee: NANO MPI HOLDINGS, INC., Milford, MI (US)

( * ) Notice: Subject to any disclaimer, the term of this patent is extended or adjusted under 35 U.S.C. 154(b) by 0 days.

(21) Appl. No.: 15/325,683

(22) PCT Filed: Jul. 22, 2014

(86) PCT No.: PCT/US2014/047555

§ 371 (c)(1),
(2) Date: Jan. 11, 2017

(87) PCT Pub. No.: WO2016/014028

PCT Pub. Date: Jan. 28, 2016

(65) Prior Publication Data

US 2017/0175020 A1 Jun. 22, 2017

(51) Int. Cl.

| | |
|---|---|
| ***C10L 1/32*** | (2006.01) |
| ***C10L 1/12*** | (2006.01) |
| ***C10L 10/02*** | (2006.01) |
| ***C10L 10/08*** | (2006.01) |

(52) U.S. Cl.

CPC ..... *C10L 1/322* (2013.01); *C10L 1/1208* (2013.01); *C10L 10/02* (2013.01); *C10L 10/08* (2013.01); *C10L 2200/0423* (2013.01); *C10L 2200/0446* (2013.01); *C10L 2230/22* (2013.01); *C10L 2250/06* (2013.01); *C10L 2270/023* (2013.01); *C10L 2270/026* (2013.01)

(58) Field of Classification Search

CPC ..... C10L 1/322; C10L 1/1208; C10L 10/02; C10L 10/08; C10L 2200/0423; C10L 2200/0446; C10L 2230/22; C10L 2250/06; C10L 2270/023; C10L 2270/026

See application file for complete search history.

(56) References Cited

U.S. PATENT DOCUMENTS

| | | | | |
|---|---|---|---|---|
| 7,115,323 | B2 * | 10/2006 | Westre | B32B 3/14 428/593 |
| 2010/0028675 | A1 | 2/2010 | Gogotsi et al. | |
| 2012/0304545 | A1 | 12/2012 | Park et al. | |
| 2013/0341028 | A1 * | 12/2013 | Christian | C09K 8/032 166/305.1 |

FOREIGN PATENT DOCUMENTS

| | | |
|---|---|---|
| WO | 2011/011714 A1 | 1/2011 |

OTHER PUBLICATIONS

Adamas Nanotechnologies, Inc. ND-Fuel: Nanodiamond-based Fuel additive, date unknown.*

International Search Report for International Application No. PCT/US2014/047555 dated May 14, 2015 (4 pages).

Written Opinion of the International Searching Authority for International Application No. PCT/US2014/047555 dated May 14, 2015 (5 pages).

* cited by examiner

*Primary Examiner* — Cephia D Toomer

(74) *Attorney, Agent, or Firm* — Fitch, Even, Tabin & Flannery, LLP

(57) ABSTRACT

A fuel and nanodiamond mixture includes a fuel for combustion and a fuel additive in the form of nanodiamonds mixed into the fuel to be dispersed throughout the fuel.

17 Claims, No Drawings

FUEL BLEND WITH NANODIAMONDS

CROSS-REFERENCE TO RELATED APPLICATIONS

This application is a U.S. national phase application filed under 35 U.S.C. § 371 of International Application No. PCT/US2014/047555, filed Jul. 22, 2014, designating the United States, which is hereby incorporated herein by reference in its entirety for all purposes.

TECHNICAL FIELD

The field of this invention relates to improved fuel blend with nanodiamonds in suspension.

BACKGROUND OF THE DISCLOSURE

Fuel efficiency has long been a high priority among industry and governments. Many modifications to engine technology are purely driven by fuel efficiency. These technical improvements include tighter manufacturing tolerances in the piston and cylinder, better materials for piston rings, hardened valves, better timing of the valve train and better recirculation of exhaust gases.

Fuel has also been improved for better fuel efficiency. Better blends and compositions of fuel have been developed. For over a hundred years petroleum has been cracked, distilled and blended to provide better octane ratings and improve combustion burn. Many of these improvements involve blending different gasoline grades and fuel additives. The fuel additives have been added for several different purposes, including changing the octane rating, removing old deposits and reducing new deposits from internal engine components, promoting longer life of the valves and for stabilizing the gasoline for longer storage. Some of these additives such as tetraethyl lead have since fallen out of favor due in part to the detrimental toxic effects of accumulating amounts of tetraethyl lead in the environment. The adoption of catalytic converters which are incompatible with lead has also greatly further diminished the use of lead as an additive. Hardened valve seats and upgraded exhaust valve materials have been introduced to compensate for the elimination of lead as an additive.

There is great development in nanodiamond materials technology. The applications for nanodiamonds have been applied as additives to oils for lubrication purposes, dry lubricants in the metal industry, reinforcing fillers for plastic and rubber, and as an additive to electroplating electrolytes. Nanodiamonds have also been used for lapping and polishing. The use of nanodiamonds as an additive to engine lubricant, i.e. oil or a synthetic, introduces the nanodiamonds into the engine via the path of the engine lubricant to the crankshaft side of the piston and piston rings. Some thin lubricant films containing nanodiamonds may then pass by the piston rings into the combustion chamber. While nanodiamonds primary crystals are produced under 10 nm in size, they tend to agglomerate after formation to particle exceeding 10 nm.

What is needed is a fuel additive having nanodiamonds that increases fuel mileage, improves fuel ignition and combustion burn, cleans valve trains and decreases wear and tear on engine parts while it reduces the toxic effects of additives on the environment. What is also needed is nonagglomerated nanodiamonds that are introduced into an engine as a fuel additive through the fuel system, for example, a fuel injector or carburetor and into the combustion chamber from an origin on the combustion side of the piston.

SUMMARY OF THE DISCLOSURE

In accordance with one aspect of the invention, a fuel and nanodiamond mixture is made from a fuel and a fuel additive in the form of nanodiamonds mixed into the fuel to be dispersed throughout the fuel. Preferably, the nanodiamonds are less than 10 nm in size and preferably between 2-10 nm in size.

The concentration of nanodiamonds to fuel is preferably between 0.0001% and 0.001% by volume relative to the fuel. The nanodiamonds are preferably detonation synthesis nanodiamonds. In one embodiment the nanodiamonds are graphenated, however, it is acceptable to use graphenated nanodiamonds or a blend of graphenated and ungraphenated nanodiamonds. The fuel is preferably one of diesel or gasoline, even though it is foreseen that kerosene, bio-diesel and all types of jet fuels are suitable. Because of the extremely small amount of additive needed and the small particle size, it is also foreseen that the nanodiamonds will also be suitable to be added to gaseous fuels; for example propane, CNG, CPG, butane, methane and hexane among others.

In accordance with another aspect of the invention, a method of making a fuel and nanodiamond mixture includes the steps of producing nanodiamonds via a detonation synthesis technology or any other method that allows the nanodiamonds to obtain a primary crystal size of 2-10 nm and to disperse in liquid media with the aim to reduce their agglomeration; refining the nanodiamonds to separate it from non-diamond material; e.g. soot; maintaining the nanodiamonds in a moist state to reduce possibility of agglomeration; and introducing the nanodiamonds into one of a petroleum based carrier, partially synthetic partially petroleum lubricant, a fully synthetic lubricant, and a petroleum based fuel.

In accordance with another aspect of the invention, a method of introducing nanodiamonds into an internal combustion engine along with fuel for the combustion cycle includes the steps of providing a moist nanodiamond mixed with a petroleum based carrier; injecting the carrier with the nanodiamond into a combustion chamber of the engine from an origin on a combustion side of a piston along with fuel before ignition to provide a mixture of nanodiamonds and fuel in the combustion chamber; and igniting the fuel and nanodiamond mixture in the combustion chamber for a power stroke. Preferably, the carrier is the fuel and nanodiamonds are introduced into the combustion chamber with the fuel from a fuel injector system or carburetor.

DETAILED DESCRIPTION OF THE PREFERRED EMBODIMENT

Significant improvement in fuel economy and environmental performance of internal combustion engines have been achieved by introducing between 0.0001% and 0.001% by volume of nanodiamonds to fuel for example, gasoline, diesel, liquefied natural gas, propane, kerosene or any hydrocarbon based fuel system. The nanodiamonds have average sizes of 2-10 nm and more preferably 4-6 nm.

Detonation synthesis or any other method which allows the nanodiamonds to obtain a particle size of 2-10 nm to be dispersed in liquid media to reduce their agglomeration is used to manufacture nanodiamonds. Detonation synthesis technology employs charges of explosive substances which are detonated in a high strength, hermetically sealed chamber. Diamond particles of nanometer size are formed from the free carbon of the molecules of the explosives. The initial detonation process creates a diamond blend that contains on average 40-50% diamonds which are then refined to a higher percentage. A refinement process may be used to extract both graphenated and ungraphenated forms of these nanodiamonds from the non-diamond material, e.g. soot.

The nanodiamonds are maintained in the refinement output moist state, i.e., it contains some amount of liquid to reduce the possibility of agglomeration and produce a stable additive product with minimal nanodiamond settling in the finished product and resulting in extended shelf life. For example, the liquid may be water, acid or urea. Reduction of agglomeration is important to maintain the size under 10 nm and preferably 4-6 nm.

The nanodiamonds can be introduced into the fuel at the refinery or downstream thereof. When added directly to the fuel, the nanodiamond concentration is between 0.0001% and 0.001% by volume to the fuel. In one embodiment, the fuel is in the form of diesel or gasoline suitable for internal combustion engines. The nanodiamonds can easily pass from a fuel tank to an engine and through fuel filters for automotive use because fuel filters are not designed to filter particles smaller than a few microns in size.

When used as an aftermarket additive, the fuel additive can have the nanodiamonds mixed into a carrier based on petroleum based lubricant, partially synthetic partially petroleum based lubricant or a fully synthetic lubricant. The preferred method of mixing the nanodiamond is by introducing the moist state nanodiamonds into the carrier using ultrasonic and mechanical mixing to reduce settling out of the nanodiamonds in the carrier. The nanodiamond mix in the carrier is preferably between 0.5% and 4% by weight. The optimal ratio of additive in the form of the carrier to the fuel is 10-30 ml of carrier per 50 liters of fuel. Other ranges outside of this are possible but with decreasing results. When the nanodiamonds are introduced as an aftermarket additive, it is preferred to add the additive first to the fuel tank and then add the gasoline, diesel or other fuel to the fuel tank to promote complete blending and suspension of the nanodiamonds in the fuel.

The results of several tests showed an increase of up to 10% in fuel efficiency depending on engine load. Furthermore, reduction of both carbon monoxide and other hydrocarbons results were as follows:

TESTING
Gasoline Engine with Catalytic Converter
Test 1

| | At Idle | | Revving | | |
|---|---|---|---|---|---|
| Options | No Nano-diamonds | With Nano-diamond Additive | Without Nano-diamonds | With Nano-diamond Additive | Improvement With Nanodiamonds |
| CO, % | 0.12 | 0.08 | 0.3 | 0.15 | 42.31% |
| HCppm | 167 | 129 | 42 | 32 | 18% |

Diesel Engine Without Catalytic Converter
Test 2

| | At Idle | | | Revving | | | |
|---|---|---|---|---|---|---|---|
| Options | No Nano-diamonds | With Nanodiamond Additive | | Without Nano-diamonds | With Nanodiamond Additive | | Improvement With Nanodiamonds |
| CO, % | 7.7 | 8.4 | 7.82 | 1.2 | 0.7 | 1.05 | 27.08% |
| HCppm | 396 | 425 | 351 | 127 | 95 | 111 | 18.9% |

It is believed that the nanodiamond blended additive to the fuel improves environment performance of engines due a more uniform and therefore complete combustion. There is a general reduction of NOx, soot, carbon monoxide and hydrocarbons. The nanodiamond additive cleans combustion chamber, and increases the efficiency and engine power. Duration is also improved by decreasing wear as shown in the test results below:

PIN AND V TEST DATA SUMMARY AND COMPARISON

| | PSI Load | Wear Scar | Coefficient of Friction |
|---|---|---|---|
| Oil Only, No Break-in | 81,605 | 0.225 | 0.116 |
| Nanodiamond, 48-Hour Break-in | 95,709 | 0.190 | 0.101 |
| Improvement | 17.3% | 15.6% | 12.9% |

In general, an increase by approximately 1.5 points in octane is obtained by adding nanodiamonds to the fuel.

The additive further reduces the load on after burning catalysts and diesel particulate filters. The elimination of metals as an additive reduces the content of harmful impurities including carcinogens in the exhaust gases. The additive apparently improves flammability of the fuel mixture and the combustion process at different loads of the engine. The nanodiamonds are believed to create more uniform points of ignition to slow the oxidation of the fuel during the compression stroke of the air-fuel mixture and to intensify the combustion process after ignition of the fuel by its high thermal conductivity which creates a more uniform flame front during the detonation down-stroke. As such, improved combustion efficiency increases the proportion of energy consumption going to perform useful work.

There is a noticeable reduction of spark plug fouling due to soot. There is improved lubrication of fuel injectors and valves, cleaner combustion chamber and restored mobility of the piston rings in the grooves of the piston during operation of an engine on the gasoline blended with the nanodiamonds. There is less soot deposited in the exhaust path which reduces the soot load on the catalysts and diesel particulate filters thereby increasing these components useful life. The engine has reduced sensitivity to fuel quality because of the increase combustion efficiency. The improved engine combustion provides reduced engine vibration and engine noise.

By adding the nanodiamond to the fuel, it is assured that a sufficient quantity is introduced into the combustion chamber from above the piston in more consistent quantities rather than via a lubricant from below the piston. The small percentage of nanodiamonds to fuel provides for an economically viable additive.

It is foreseen to use the nanodiamonds in fuels for other purposes, i.e. alcohol, liquefied natural gas or propane based fuel as well as solid or gel based fuels for applications other than internal combustion engines.

Variations and modifications are possible without departing from the scope and spirit of the present invention as defined by the appended claims.

The embodiments in which an exclusive property or privilege is claimed are defined as follows:

1. A fuel and nanodiamond mixture comprising:

a fuel for providing combustion; and a fuel additive in the form of nanodiamonds mixed into the fuel to be ultra dispersed throughout said fuel; and wherein said nanodiamonds are a blend of qraphenated and unqraphenated nanodiamonds.

2. The fuel and nanodiamond mixture as defined in claim 1, wherein said nanodiamonds are less than 10 nm in size.

3. The fuel and nanodiamond mixture as defined in claim 2 wherein said nanodiamonds are in a range of 2-10 nm in size.

4. The fuel and nanodiamond mixture as defined in claim 3 wherein said nanodiamonds are in a range of between 0.0001% and 0.001% by volume relative to the fuel.

5. The fuel and nanodiamond mixture as defined in claim 4 wherein said nanodiamonds are formed by a method that allows the nanodiamonds to obtain a primary crystal size of 2-10 nm and to be ultra dispersed in liquid media to reduce their agglomeration.

6. The fuel and nanodiamond mixture as defined in claim 5 wherein said nanodiamonds are detonation synthesis nanodiamonds.

7. The fuel and nanodiamond mixture as defined in claim 1, wherein said fuel is one of diesel fuel or gasoline.

8. The fuel and nanodiamond mixture as defined in claim 2 wherein said nanodiamonds are in a range of between 0.0001% and 0.001% by volume relative to the fuel.

9. The fuel and nanodiamond mixture as defined in claim 7 wherein said nanodiamonds are formed by a method that allows the nanodiamonds to obtain a primary crystal size of 2-10 nm and to be ultra dispersed in liquid media to reduce their agglomeration.

10. The fuel and nanodiamond mixture as defined in claim 8 wherein said nanodiamonds are detonation synthesis nanodiamonds.

11. The fuel and nanodiamond mixture as defined in claim 1 wherein said nanodiamonds are in a range of between 0.0001% and 0.001% by volume relative to the fuel.

12. A method of making a fuel and nanodiamond mixture comprising:

producing a blend of qraphenated and unqraphenated nanodiamonds via a method that allows the nanodiamonds to obtain a primary crystal size of 2-10 nm to be ultra dispersed in liquid media to of reduce their agglomeration; refining said nanodiamonds from non-diamond material;

maintaining said nanodiamonds in a moist state to reduce agglomeration; and introducing said nanodiamonds into one of a petroleum based carrier; partially synthetic partially petroleum lubricant, a fully synthetic lubricant, and a petroleum based fuel.

13. The method as defined in claim 12 wherein said step of producing nanodiamonds is by detonation synthesis technology.

14. A method of introducing nanodiamonds along with fuel for the combustion cycle into an internal combustion engine having a combustion chamber with a piston, said method comprising:

mixing a moist blend of graphenated and ungraphenated nanodiamonds with a petroleum based carrier;

injecting said carrier with said nanodiamonds therein into said combustion chamber from an origin source on the combustion side of said piston along with fuel before ignition to provide a mixture of nanodiamonds and fuel; and igniting said mixture of nanodiamonds and fuel in said combustion chamber for producing a power stroke.

15. The method as defined in claim 14 wherein said carrier is said fuel and nanodiamonds are introduced into said combustion chamber with said fuel from a fuel injector.

16. The method as defined in claim 15 wherein said nanodiamonds are between 0.0001% and 0.001% by volume relative to said fuel.

17. The method as defined in claim 16 wherein said nanodiamonds are 2-10 nm in size.

* * * * *